United States Patent [19]

Terai et al.

[11] 4,203,490

[45] May 20, 1980

[54] HEAT EXCHANGER CORE HAVING FIN MEMBERS SERVING AS SACRIFICIAL ANODES

[75] Inventors: Shiro Terai; Zenichi Tanabe, both of Nagoya; Toshiyasu Fukui, Toyoake, all of Japan

[73] Assignees: Sumitomo Light Metal Industries, Ltd., Tokyo; Nippondenso Co., Ltd., Kariya, both of Japan

[21] Appl. No.: 953,114

[22] Filed: Oct. 20, 1978

[30] Foreign Application Priority Data

Oct. 21, 1977 [JP] Japan ..... 52-125858

[51] Int. Cl.[2] ..... F28F 19/06

[52] U.S. Cl. ..... 165/134 R; 165/180; 428/933

[58] Field of Search ..... 165/133, 134, 180, DIG. 8; 428/933

[56] References Cited

U.S. PATENT DOCUMENTS

| | | | |
|---|---|---|---|
| 752,844 | 2/1904 | Kinnear | 165/134 |
| 2,719,354 | 10/1955 | Dalin | 165/134 |
| 2,960,114 | 11/1960 | Hinde | 165/134 |
| 3,440,140 | 4/1969 | Sawatzky | 165/134 |
| 3,960,208 | 6/1976 | Anthony et al. | 165/134 |

FOREIGN PATENT DOCUMENTS

| | | | |
|---|---|---|---|
| 45-187 | 7/1970 | Japan | 165/134 |
| 507507 | 6/1939 | United Kingdom | 165/134 |
| 981801 | 1/1965 | United Kingdom | 165/134 |

*Primary Examiner*—Sheldon Richter

*Attorney, Agent, or Firm*—Blanchard, Flynn, Thiel, Boutell & Tanis

[57] ABSTRACT

The heat exchanger core comprises a fluid passage member, within which a fluid flows and outside of which another fluid flows and fin members formed on the fluid passage member for promoting heat exchange between the two fluids. The fluid passage member and the fin members are made of different kinds of aluminum alloys. The fin members serve as sacrificial anodes as well for protecting the heat exchanger core from corrosion.

8 Claims, 2 Drawing Figures

HEAT EXCHANGER CORE HAVING FIN MEMBERS SERVING AS SACRIFICIAL ANODES

BACKGROUND OF THE INVENTION

The present invention relates to a heat exchanger core comprising a fluid passage member within which a fluid flows and outside of which another fluid flows and fin members formed thereon for promoting the heat exchange between the two fluids, and more particularly to a heat exchanger core whose fluid passage member is made of an aluminum-base alloy and whose fin members serve as sacrificial anodes as well for protecting the fluid passage member from corrosion.

Generally, in a heat exchanger core for use in air-cooled heat exchangers, a hot fluid flows within the heat exchanger core and air is made to flow outside of the heat exchanger core for the purpose of cooling. In the case where the heat exchange core is made of an aluminum-base alloy and is assembled by brazing, one or both members of the fluid passage member and the fin members are made of a brazing sheet. The brazing sheet comprises a core metal layer made of aluminum or corrosion-resistant aluminum alloy, and a cladding metal layer made of Al-Si-base alloy or Al-Si-Mg-base alloy, which is formed on the core metal layer.

In the case where the fluid passage member of the heat exchanger core is made of such a brazing sheet, and the fin members are made of aluminum or corrosion-resistant aluminum alloy, considerable corrosion of the heat exchanger core occurs when the air-cooled side of the heat exchanger core is exposed to a corrosive atmosphere. Therefore, the application of such air-cooled heat exchanger is significantly limited. In other words, in the conventional heat exchanger, a soldered fillet portion between the fluid passage member and the fin members becomes a cathode, while the fluid passage member itself becomes an anode and a corrosion-current flows from the fluid passage member to the fillet portion, so that the fluid passage member is corroded.

SUMMARY OF THE INVENTION

It is therefore an object of the present invention to provide a corrosion-resistant heat exchanger core.

According to the present invention, fin members which are attached to the outer surface of the fluid passage member for increasing the heat exchange efficiency also serve as sacrificial anodes by an appropriate combination of the materials used in the heat exchanger core and the fin members, so that the heat exchanger core is protected from corrosion, while the corrosion speed of the fin members is minimized.

The heat exchanger core according to the present invention can find wide application since corrosion of the fluid passage member is prevented by the fin members. Thus, it can be employed not only in air-cooled heat exchangers, but also in liquid-liquid heat exchangers.

BRIEF DESCRIPTION OF THE DRAWINGS

For a better understanding of the invention as well as the object and other features, reference will be had to the following detailed description which is to be read in conjunction with the drawings wherein.

DETAILED DESCRIPTION OF THE PREFERRED EMBODIMENTS

Figure 1:
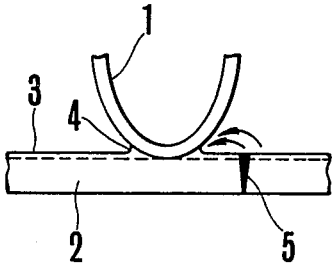
FIG. 1 illustrates schematically a corrosion state of part of the conventional heat exchanger core.

In the present invention, each fin member is comprised of an aluminum-base alloy selected from the group consisting of:

(1) aluminum-base alloy containing Sn in the range of 0.02 to 0.09 wt %.

(2) aluminum-base alloy containing Sn in the range of 0.02 to 0.09 wt %, and at least one material selected from the group consisting of Mg in the range of 0.01 to 2 wt %, Mn in the range of 0.1 to 2 wt %, Zn in the range of 0.1 to 5 wt %, Cu in the range of 0.01 to 2 wt %, Si in the range of 0.01 to 2 wt %, and Cr in the range of 0.01 to 0.5 wt %.

In the above-mentioned two types of aluminum-base alloys, in addition to the above-mentioned material(s), In, Ga or Bi can be contained solely or in combination thereof in a total amount which does not exceed the range of 0.01 to 0.5 wt %, which can assist the effect of sacrificial anode of the fin members. Furthermore, impurities, such as Fe, Ti, B, Ni and Ca, whose contamination is usually tolerable, may be contained in each aluminum-base alloy for use in the fin members, whose total amount is not more than 2 wt %.

A brazing sheet for forming a fluid passage member according to the present invention comprises a core metal layer made of aluminum or corrosion-resistant aluminum alloy, such as Al-Mn-base alloy, Al-Mg-base alloy, Al-Mn-Mg-base alloy, Al-Mg-Si-base alloy, and a cladding metal layer containing Si in the range of 6 to 14 wt % or Si and Mg in combination, in the range of 6 to 14 % and in the range of 0.3 to 3 wt %, respectively. The cladding metal layer may contain one element selected from the group consisting of Bi, Be, Sb, Sr, Ba, Li, K, Ca, Pb and rare-earth elements or in combination thereof so long as the total amount of the element(s) is in the range of 0.001 to 0.5 wt %. These elements can assist the soldering of the fin members. Furthermore, impurities, such as Fe, Cu, Cr, Mn, Zn, Ti, Zr, B, Ni, whose contamination is usually tolerable, may be contained in the aluminum-base alloy for use in the cladding metal layer so long as the total amount of the impurities is in the range of not more than 2 wt %.

In the present invention, the heat exchanger core comprises a fluid passage member within which a fluid flows, and the fin members which are formed on the outer surface of the fluid passage member, and the fin members are joined with the fluid passage member by soldering.

Sn is contained in the fin members in order to make the fin members anodic, so that each of the fin members serves as a sacrificial anode for preventing the core metal of the brazing sheet which forms the fluid passage member of the heat exchanger core from being corroded. When the content of Sn in the fin members exceeds 0.09 wt %, the plasticity of the aluminum alloy for use in the fin members becomes too low to make the fin members and it becomes difficult to solder the fin members.

On the other hand, when the content of Sn in the fin members is less than 0.02 wt %, the corrosion-preventing effect by the fin members which serve as the sacrificial anodes is not generated. The substances, such as Mg, Mn, Zn, Cu, Si, Cr, Zr, which can be contained in the fin members, serve to improve the strength, the sagging-resistance, and the molding capability of the fin members. When the contents of those substances exceed their respective upper limits which have been previously mentioned, it becomes difficult to solder the fin members with the fluid passage member. On the other hand, when the contents of those substances do not reach their previously mentioned respective lower limits, they do not contribute to improvement of the strength, the sagging-resistance, and the molding capability of the fin members.

The reason for having the defined composition of the cladding metal layer of the brazing sheet for forming the fluid passage member in the present invention is that it is necessary that the cladding metal be maintained comparatively in an anodic state in a temperature range from room temperature to 100° C. in contrast to the core metal comprising aluminum or an aluminum alloy, which is maintained in a cathodic state.

When a heat exchanger core is assembled by use of the fin members and the fluid passage member having the above-mentioned compositions, respectively, the fin members become sacrificial anodes, so that the fluid passage member is protected from corrosion.

Referring to FIG. 1, there is shown a schematic sectional view of part of an example of the conventional heat exchanger cores. In the FIGURE, reference numeral 1 represents a fin member, reference numeral 2 represents a core metal of a material for forming a fluid passage member, reference numeral 3 represents a cladding metal of the material for forming the fluid passage member and reference numeral 4 represents a soldered fillet porition. In this example, the soldered fillet portion 4 becomes cathodic and the core metal 2 becomes anodic, so that a corrosion-current flows from the core metal 2 to the soldered fillet portion 4 as indicated by the arrow, so that pitting corrosion 5 occurs in the core metal 2.

Figure 2:
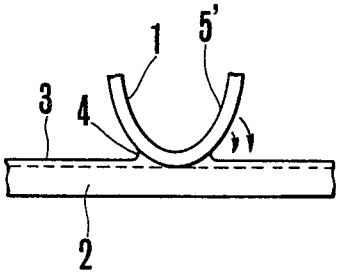
FIG. 2 illustrates schematically the function of a sacrificial anode according to the present invention.

Referring to FIG. 2, there is shown a schematic sectional view of an embodiment of a heat exchanger core according to the present invention. In the FIGURE, the same members as in FIG. 1 are given the same reference numerals. In this case, the fin member 1 is anodic and the fillet portion 4 and the core metal 2 are cathodic, and electric current flows in the direction of the arrow, so that pitting corrosion occurs in the fin member 1.

Table 1 shows the chemical compositions of a variety of fin members tested in the present invention, and the electric potential of each fin member.

Table 2 shows the chemical composition of a variety of the brazing sheets tested in the present invention.

Table 1

| | Chemical Composition of Tested Aluminum Alloys for Fin Members and their Electric Potentials after Soldering | | | | | | | | | |
|---|---|---|---|---|---|---|---|---|---|---|
| No. | Sn | Mg | Mn | Zn | Cu | Si | Cr | Zr | Note | Electric Potential (volt) |
| A | 0.03 | | | | | | | | | −0.82 |
| B | 0.07 | | | | | 1.0 | | | | −0.89 |
| C | 0.04 | 1.5 | | | | | | | | −0.86 |
| D | 0.08 | | 1.2 | | | | | | | −0.90 |
| E | 0.05 | | | 2 | | | | | | −0.89 |
| F | 0.07 | | | | 0.5 | | | | | −0.91 |
| G | 0.06 | 1.0 | | | | 0.5 | | | | −0.89 |
| H | 0.04 | | | | | | 0.2 | | | −0.84 |
| I | 0.03 | | | | | | | 0.2 | | −0.83 |
| J | 0.08 | | 1.0 | | | | 0.1 | 0.1 | | −0.91 |
| K | | | 1.2 | | 0.1 | | | | AA 3003 | −0.67 |
| L | | 1.0 | 1.2 | | | | | | AA | −0.68 |

Table 1-continued

| | Chemical Composition of Tested Aluminum Alloys for Fin Members and their Electric Potentials after Soldering | | | | | | | | | |
|---|---|---|---|---|---|---|---|---|---|---|
| No. | Sn | Mg | Mn | Zn | Cu | Si | Cr | Zr | Note | Electric Potential (volt) |
| | | | | | | | | | 3004 | |

Note 1. Soldering Condition: $10^{-5}$ Torr, 600° C. × 5 min.
Note 2. Electric Potential after Soldering: Electric Potential (volt) in 3% NaCl Aqueous Solution by Saturated Calomel Electrode Standard
Note 3. Unit of the Chemical Composition in Table 1 is wt %.

Table 2

| | Chemical Composition of Tested Brazing Sheets | | | | | | |
|---|---|---|---|---|---|---|---|
| No. | Name of Aluminum Alloy of Core Metals | Chemical Compositions of Cladding Metals (wt %) (Note 1) Si | Mg | Bi | Be | Sb | Sr |
| a | AA3003 | 7.5 | | | | | |
| b | AA1100 | 10 | | | | | |
| c | AA3003 | 10 | 1.5 | | | | |
| d | AA3004 | 12 | 1.0 | 0.1 | | | |
| e | AA6951 | 7.5 | | 0.2 | | 0.02 | |
| f | AA3004 | 12 | | 0.01 | 0.01 | 0.05 | 0.02 |

(Note 1) The main component of each cladding metal is aluminum.

Table 3 summarizes the results of alternating dipping tests and salt spray corrosion tests of the heat exchanger cores performed by use of the fin members and the brazing sheets in combination, which are given in Table 1 and Table 2, and the employed soldering methods for the respective heat exchanger cores.

Table 3

| | Combination of Materials | | Test Results | | |
|---|---|---|---|---|---|
| No. | Fin Member | Brazing Sheet | Alternating Dipping Test Corroded Depth (mm) | Salt Spray Corrosion Test Corroded Depth (mm) | Note |
| 1 | A | a | 0.14 | 0.06 | |
| 2 | G | a | 0.12 | 0.05 | |
| 3 | C | a | 0.16 | 0.08 | Flux |
| 4 | D | b | 0.07 | 0.04 | Soldering |
| 5 | B | b | 0.10 | 0.06 | |
| 6 | H | b | 0.12 | 0.08 | |
| 7 | I | c | 0.13 | 0.07 | |
| 8 | E | c | 0.11 | 0.07 | Vacuum |
| 9 | C | c | 0.16 | 0.06 | Soldering |
| 10 | D | d | 0.08 | 0.04 | |
| 11 | J | d | 0.10 | 0.06 | |
| 12 | F | d | 0.11 | 0.04 | |
| 13 | G | e | 0.12 | 0.06 | |
| 14 | I | e | 0.13 | 0.07 | Soldering in Inert Gas |
| 15 | A | e | 0.12 | 0.03 | Atmosphere |
| 16 | H | f | 0.15 | 0.07 | |
| 17 | F | f | 0.10 | 0.07 | |
| 18 | B | f | 0.09 | 0.06 | |
| 19 | K | a | >0.4 | 0.23 | Flux Soldering |
| 20 | L | c | >0.4 | 0.23 | Vacuum Soldering |
| 21 | K | e | >0.4 | 0.24 | Soldering in Inert Gas Atmosphere |

In the tests summarized in Table 3, each sample is cooled at a cooling speed of 20° C./min. after soldering.

Alternating Dipping Test

Each soldered sample is immersed in a 3% NaCl aqueous solution (pH=3) at 40° C. for 30 minutes, and is then dried at 50° C. for 30 minutes. This cycle is repeated for one month. After this test, when the maximum corroded depth is less than 0.2 mm, the sample is judged good, and when the maximum corroded depth is 0.2 mm or more, the sample is judged defective.

Salt Spray Corrosion Test

In accordance with Japanese Industrial Standard (JIS).Z.2371, each sample is tested for one month. When the maximum corroded depth is less than 0.1 mm, the sample is judged good, and when the maximum corroded depth is 0.1 mm or more, the sample is judged defective.

What is claimed is:

1. In a heat exchanger core comprising a fluid passage member within which a fluid is adapted to flow and outside of which another fluid is adapted to flow, and fin members mounted on the external surface of said fluid passage member, said fluid passage member being made of a brazing sheet consisting essentially of an internal layer made of a core metal and defining the internal layer of said fluid passage member and an external layer made of a cladding metal and defining the external layer of said fluid passage member, the improvement which comprises: said core metal is a material selected from the group consisting of aluminum and corrosion-resistant aluminum alloy, and is effective to maintain said internal layer in a cathodic state relative to said external layer of said cladding metal and said fin members; said cladding metal is an aluminum alloy containing from 6 to 14 weight percent of Si and effective to maintain said external layer in an anodic state relative to said internal layer in a temperature range of from room temperature to 100° C.; and said fin members are made of aluminum alloy containing from 0.02 to 0.09 weight percent of Sn, said fin members being soldered to said external layer and being effective as sacrificial anodes to protect said fluid passage member from corrosion.

2. A heat exchanger core as claimed in claim 1, wherein said aluminum alloy forming said fin members further comprises at least one material selected from the group consisting of Mg in an amount of 0.01 to 2 weight percent, Mn in an amount of 0.1 to 2 weight percent, Zn in an amount of 0.1 to 5 weight percent, Cu in an amount of 0.01 to 2 weight percent, Si in an amount of 0.01 to 2 weight percent, Cr in an amount of 0.01 to 0.5 weight percent, Zr in an amount of 0.01 to 0.5 weight percent and the balance is essentially aluminum.

3. A heat exchanger core as claimed in claim 1 or claim 2 wherein said core metal is selected from the group consisting of aluminum, aluminum-manganese alloy, aluminum-magnesium alloy, aluminum-manganese-magnesium alloy and aluminum-magnesium-silicon alloy; and wherein said cladding metal contains up to 0.05 weight percent of one or a mixture of Bi, Be, Sb, Sr, Ba, Li, K, Ca, Pb and rare earth elements, and the balance is essentially aluminum.

4. A heat exchanger core as claimed in claim 2, wherein said aluminum alloy forming said fin members further comprises up to 2.0 weight percent of one or a mixture of Fe, Ti, B, Ni and Ca.

5. In a heat exchanger core comprising a fluid passage member within which a fluid is adapted to flow and outside of which another fluid is adapted to flow, and fin members mounted on the external surface of said fluid passage member, said fluid passage member being made of a brazing sheet consisting essentially of an internal layer made of a core metal and defining the internal layer of said fluid passage member and an external layer made of a cladding metal and defining the external layer of said fluid passage member, the improvement which comprises: said core metal is a material selected from the group consisting of aluminum and corrosion-resistant aluminum alloy, and is effective to maintain said internal layer core metal in a cathodic state relative to said external layer of said cladding metal and said fin members; said cladding metal is an aluminum alloy containing from 6 to 14 weight percent of Si and from 0.3 to 3 weight percent of Mg and effective to maintain said external layer in an anodic state relative to said internal layer in a temperature range of from room temperature to 100° C.; and said fin members are made of aluminum alloy containing from 0.02 to 0.09 weight percent of Sn, said fin members being soldered to said external layer and being effective as sacrificial anodes to protect said fluid passage member from corrosion.

6. A heat exchanger core as claimed in claim 5, wherein said aluminum alloy forming said fin members further comprises at least one material selected from the group consisting of Mg in an amount of 0.1 to 2 weight percent, Mn in an amount of 0.1 to 2 weight percent, Zn in an amount of 0.1 to 5 weight percent, Cu in an amount of 0.01 to 2 weight percent, Si in an amount of 0.01 to 2 weight percent, Cr is an amount of 0.01 to 0.5 weight percent, and the balance is essentially aluminum.

7. A heat exchanger core as claimed in claim 5 or claim 6 wherein said core metal is selected from the group consisting of aluminum, aluminum-manganese alloy, aluminum-magnesium alloy, aluminum-manganese-magnesium alloy and aluminum-magnesium-silicon alloy; and wherein said cladding metal contains up to 0.5 weight percent of one or a mixture of Bi, Be, Sb, Sr, Ba, Li, K, Ca, Pb and rare earth elements, and the balance is essentially aluminum.

8. A heat exchanger core as claimed in claim 6, wherein said aluminum alloy forming said fin members further comprises up to 2.0 weight percent of one or a mixture of Fe, Ti, B, Ni and Ca.

* * * * *